US007352331B2

(12) United States Patent
Quagliaro

(10) Patent No.: US 7,352,331 B2
(45) Date of Patent: Apr. 1, 2008

(54) SPACE TELECOMMUNICATIONS INTEGRATED ANTENNA SYSTEM FOR MOBILE TERRESTRIAL STATIONS (SATCOMS)

(75) Inventor: Gilles Quagliaro, Cormeilles en Parisis (FR)

(73) Assignee: Thales (FR)

( * ) Notice: Subject to any disclaimer, the term of this patent is extended or adjusted under 35 U.S.C. 154(b) by 206 days.

(21) Appl. No.: 11/235,530

(22) Filed: Sep. 27, 2005

(65) Prior Publication Data

US 2006/0071867 A1 Apr. 6, 2006

(30) Foreign Application Priority Data

Sep. 28, 2004 (FR) ..... 04 10268

(51) Int. Cl.
*H01Q 1/28* (2006.01)

(52) U.S. Cl. ..... 343/705; 343/700 MS

(58) Field of Classification Search ..... 343/700 MS, 343/713, 705, 708
See application file for complete search history.

(56) References Cited

U.S. PATENT DOCUMENTS

| | | | | |
|---|---|---|---|---|
| 4,914,448 | A * | 4/1990 | Otsuka et al. | 343/872 |
| 4,990,926 | A * | 2/1991 | Otsuka et al. | 343/700 MS |
| 2004/0017316 | A1* | 1/2004 | Tanaka et al. | 343/700 MS |
| 2007/0013593 | A1* | 1/2007 | Zafar et al. | 343/713 |

FOREIGN PATENT DOCUMENTS

| | | |
|---|---|---|
| EP | 0 867 969 | 9/1998 |
| JP | 08162883 A | 10/1996 |

* cited by examiner

*Primary Examiner*—Hoanganh Le
(74) *Attorney, Agent, or Firm*—Lowe Hauptman Ham & Berner, LLP

(57) ABSTRACT

An integrated antenna system for telecommunications comprises at least one substantially flat and circular antenna provided with a rotation axis coinciding with its axis, the antenna being fixedly joined to a support itself comprising a rotation axis. The rotation axis of the antenna is inclined by an angle θ relative to the rotation axis of the antenna support and the antenna beam forms an angle ϕ relative to the rotation axis of the antenna.

8 Claims, 2 Drawing Sheets

4b

SPACE TELECOMMUNICATIONS INTEGRATED ANTENNA SYSTEM FOR MOBILE TERRESTRIAL STATIONS (SATCOMS)

RELATED APPLICATION

The present application is based on France Application, and claims priority from Application No. 0410268 filed Sep. 28, 2004, the disclosure of which is hereby incorporated by reference in its entirety.

BACKGROUND OF THE INVENTION

1. Field of the Invention

The invention relates especially to an integrated antenna system in space telecommunications for mobile terrestrial stations (Satcom).

It can also be used in related fields such as radars or RF beams whenever the antenna system is in motion relative to its carrier.

In space telecommunications using the C, X, Ku, Ka, Q and other bands, with existing geostationary satellites, the mobile terrestrial stations are supposed to be equipped with an agile antenna automatically aimed at the traffic satellite, whatever its position in the sky (all the elevation angles from 0 to 90°, all the relative bearing angles from 0 to 360°).

In the description, the vertical and horizontal directions are referenced in the figures. They relate for example to a ground assumed to be horizontal and plane, referenced S, or again a place in which the antenna is positioned.

2. Description of the Prior Art

FIG. 1 exemplifies a commonly used prior-art antenna system. The antenna is a motor-driven parabolic antenna 1, herein represented with its main reflector 2 and its source 3. The assembly is protected by a radome 4. FIG. 1 shows the antenna in three positions of elevation, respectively a horizontal position, a 45° position and a vertical position. The internal volume of the radome 4 is mostly occupied by the antenna 1 and its displacement. All things considered, there therefore remains little space to house the equipment associated with the antenna, such as the drive system, the power amplifier, the low-noise amplifier, the transpositions and all the equipment habitually associated with the working of an antenna. A part of these devices is sometimes transferred into other compartments of the station, often in an inconvenient way.

Another prior art solution consists of the use of an electronically scanned antenna 5, as shown in FIG. 2. This type of antenna especially has the properties of being plane and of being capable of electronically deflecting its beam along an axis "A". FIG. 2 shows an antenna performing an electronic scan 6 in elevation and a mechanical deflection in relative bearing 7. Relative to the antenna of FIG. 1, there is no longer any antenna displacement. In comparing FIG. 1 and FIG. 2, it is noted that a major part of the volume initially occupied by the displacement of the antenna is freed and therefore made available (this is the volume referenced 8 in the figure).

This approach nevertheless comes up against difficulties relative to the electronically scanned antenna, namely cost, performance, etc.

The antenna system according to the invention relies on a novel approach which judiciously uses a flat antenna whose antenna beam is fixed but deflected from the mechanical axis of the antenna, this beam being also inclined relative to a main mechanical axis.

SUMMARY OF THE INVENTION

The invention relates to an integrated antenna system for telecommunications comprising at least one substantially flat and circular antenna provided with a rotation axis coinciding with its axis, the antenna being fixedly joined to a support itself comprising a rotation axis wherein the rotation axis of the antenna is inclined by an angle $\theta$ relative to the rotation axis of the antenna support and the antenna beam forms an angle $\phi$ relative to the rotation axis of the antenna.

The diameter of the antenna is, for example, chosen as a function of the communications application.

The angle $\theta$ is, for example, equal to 45° degrees relative to a second axis of rotation (axis of rotation of the support) that is substantially vertical, and the angle $\phi$ is equal to 45°. The assembly thus has the property wherein, by rotation of each of the angles and according to the values taken, the half-angle located above the horizontal is covered by the antenna beam.

The antenna system according to the invention has the decisive advantage of using a simple fixed-beam, passive, flat antenna whose design can be optimized for the inclination of the beam chosen. The radio-electrical performance in terms of antenna gain in the axis of the beam, as well as of off-axis radiation in terms of minor lobes are then optimal and kept constant whatever the aiming sought.

The antenna system of the invention also has the advantage of being compact and integrated. The rotation on both axes enables a significant field of aim to be covered. The volume initially necessary for the displacement of the parabola is freed to make way for equipment associated with the antenna.

BRIEF DESCRIPTION OF THE DRAWINGS

Other features and advantages of the invention shall appear more clearly from the following description of an exemplary embodiment given by way of an illustration that in no way limits the scope of the invention and from the appended figures, of which.

MORE DETAILED DESCRIPTION

Figure 1:
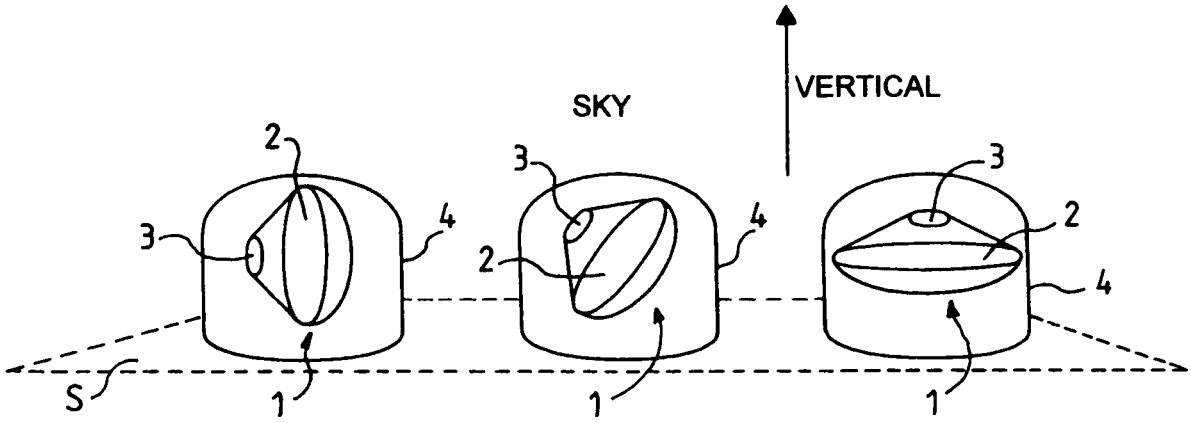
FIG. 1 exemplifies a prior-art antenna system.
Figure 2:
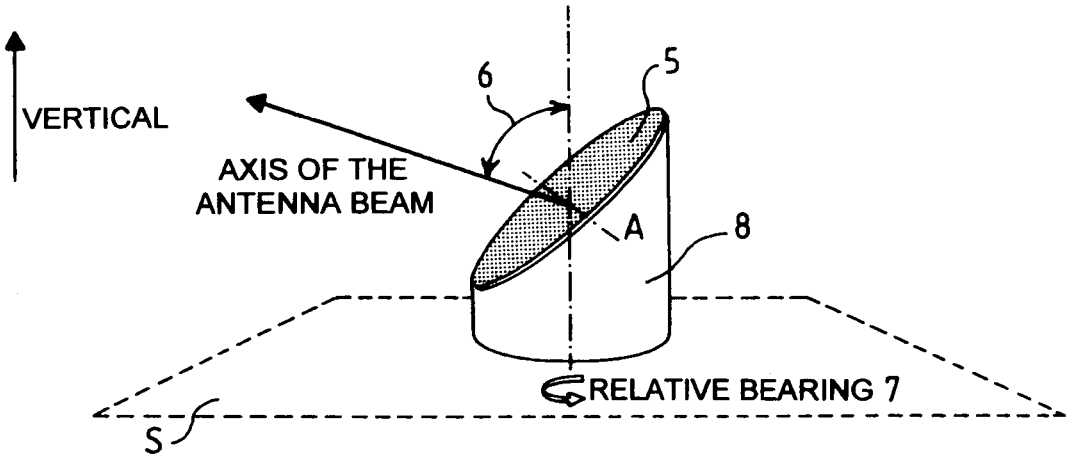
FIG. 2 shows a solution using a prior-art compact electronically scanned antenna, FIG. 3 exemplifies an antenna illustrating the principle implemented by the invention.
Figure 3:
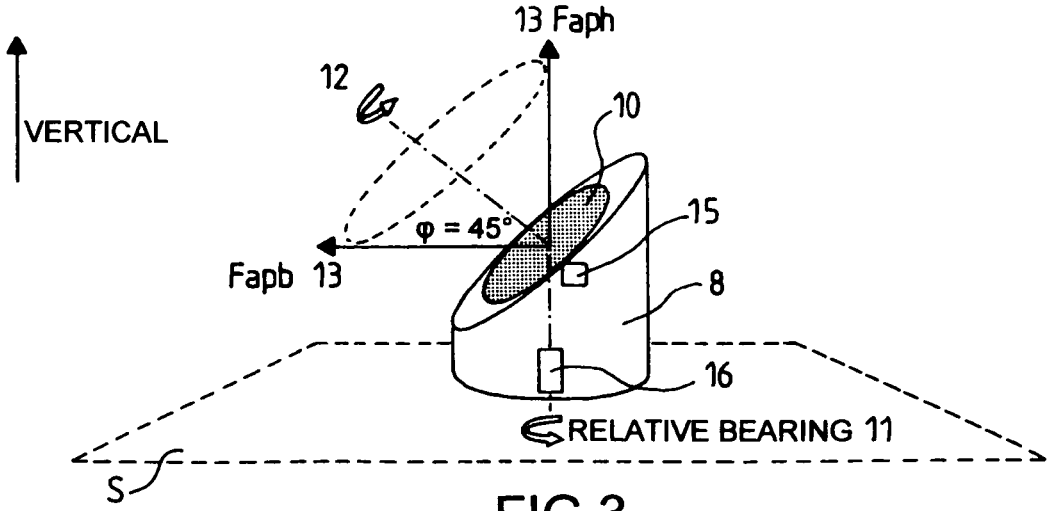

FIG. 3 is a schematic view of an antenna system comprising a circular, flat antenna 10, with a beam inclined, for example by $\phi$=45° relative to its mechanical axis 12, itself inclined by 45 relative to the vertical to the position. The antenna rotates on its own mechanical axis 12, and a motor 15 enables this rotation. The antenna is associated with a vertical axis of rotation in relative bearing 11 also motor-driven 16. The other elements associated with the antenna and known to those skilled in the art are not shown because they do not play any role in the understanding of the invention.

According to this arrangement, a rotation of the antenna on its mechanical axis 12 causes the antenna beam 13 to travel on a cone with a 90° vertex angle, the beam passing through all the elevation values from horizontal to vertical (low antenna beam position $F_{apb}$ and high antenna beam position $F_{aph}$). The rotation of the antenna on the relative bearing axis enables the beam to be rotated in every direction of relative bearing necessary in order to aim at a satellite.

More generally, if $\theta$ is the inclination of the mechanical axis of the antenna relative to the vertical to the position and $\phi$ is the inclination of the beam relative to the mechanical axis of the antenna, the rotation of the antenna on its mechanical axis makes it possible to attain all the elevation values ranging from $(\theta+\phi)$ to $(\theta-\phi)$ relative to the vertical, giving an angular sector equal to twice the smallest value of $\theta$ or $\phi$, that is twice $\min(\theta, \phi)$.

For $\theta=\phi=45$ degrees, the beam therefore takes all the elevation values ranging from 0 to 90 degrees as indicated in FIG. 3.

In order to more clearly understand the principle implemented in the invention, the following example relates to an integrated antenna system mounted on the fuselage of an airliner. In this application, the antenna system must have small thickness to limit aerodynamic drag.

FIGS. 4A and 4B provide a schematic view in section and a view in perspective of an antenna installed on a fuselage of an airline, whose dimensions are given by way of a non-restrictive example.

Figure 4:
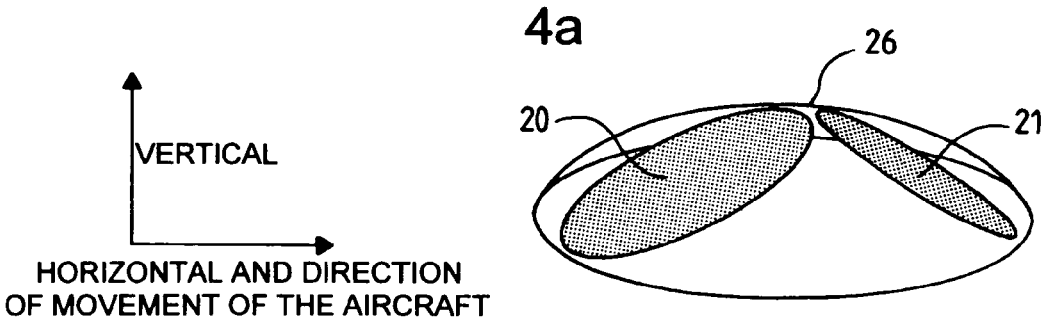
FIG. 4A is a view in section and FIG. 4B is a view in perspective of an alternative embodiment of the antenna system of FIG. 3 comprising two antennas.
Figure 4:
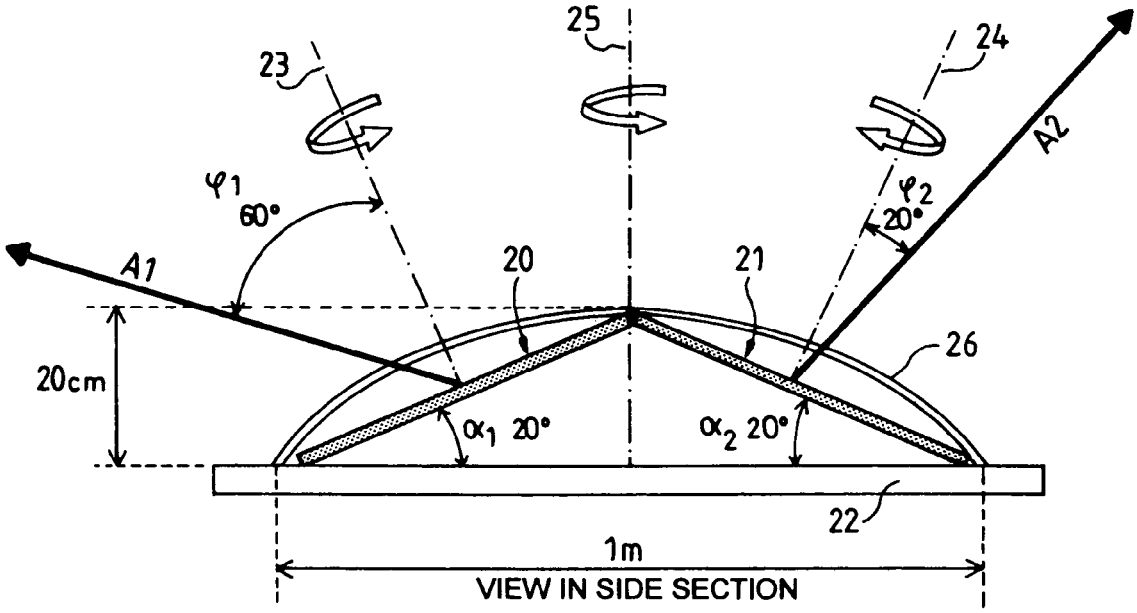

The antenna system of FIG. 4 comprises two circular, flat antennas 20, 21 with a diameter of 50 cm; the antennas are arranged relative to a support 22 supposed to be horizontal (in practice, the top of the aircraft fuselage). The value of the diameter of the antennas, respectively $D_1$ and $D_2$, is chosen for example as a function of the radio-transmission application. Each of the antennas 20, 21 (the plane of the antenna which is inclined) is inclined, for example, by an angle $\alpha_1=\alpha_2=20$ degrees relative to the support 22. Each antenna rotates on its mechanical axis, respectively 23, 24. The first antenna 20 has a beam inclined by an angle $\phi_1=60°$ and the second antenna has a beam inclined by an angle $\phi_2=20°$. The assembly rotates in relative bearing about a main axis 25 vertical to the support on which the antenna is positioned. All the mechanical axes are motor-driven by means of motors which are not shown because they do not play a direct part in the principle of the invention. The antenna system is protected, for example, by a radome 26 having a circular base with a diameter of one meter and a thickness of 20 cm.

According to this arrangement, the first antenna 20 covers the elevation angles from 10 to 50 degrees (40 to 80 degrees relative to the vertical 25), the second antenna 21 covers the elevation angles from 50 to 90 degrees (0 to 40 degrees relative to the vertical 25 defined here above). The assembly makes it possible to reach especially all the elevation angles ranging from 10 to 90 degrees (0 to 80 degrees relative to the vertical 25) and all the relative bearing angles ranging from 0 to 360 degrees, giving the totality of the sector necessary for an airliner. The space available beneath flat antennas is available, for example, for housing the different pieces of equipment related to the antenna and obtaining a small-sized integrated system.

What is claimed is:

1. An integrated antenna system for telecommunications comprising:

at least two flat, substantially circular rotatable antennas fixedly joined to a single rotatable antenna support having a rotation axis central to the at least two antennas, each antenna being provided with a rotation axis coinciding with its axis, the at least two antennas having a diameter $D_1$, $D_2$, respectively;

wherein each antenna is inclined at an angle $\alpha$ relative to the antenna support;

wherein each antenna has a beam inclined at an angle relative to its axis of rotation, such that the multiple antennas cover complementary and different elevation fields and;

wherein the antenna system comprises a device adapted to making the antennas and their support rotate.

2. An antenna system according to claim 1 wherein the angle $\alpha$ for a first antenna and a second antenna=20 degrees, and the beam inclination angle for the first antenna, and the beam inclination angle for the second antenna is approximately 60° and 20°, respectively.

3. An antenna system according to claim 2 comprising a radome housing the antennas, the antenna support, and the device adapted to rotate the antennas and antenna support.

4. An antenna system according to claim 1 wherein the diameter of each antenna is chosen as a function of the communications application.

5. An antenna system according to claim 1 comprising a radome housing the antennas, the antenna support, and the device adapted to rotate the antennas and antenna support.

6. An antenna system according to claim 1, positioned on an aircraft fuselage.

7. An antenna system according to claim 5, wherein the radome includes a circular base of about one meter and a thickness of about 20 cm.

8. A method for sending out multiple antenna beams in a telecommunications system comprising an antenna assembly that includes at least two substantially circular, flat antennas with a diameter $D_1$, $D_2$, mounted thereon, the antenna assembly having a main vertical axis central to the at least two antennas, wherein each antenna is inclined by a first angle relative to an antenna support, the method comprising:

transmitting a first antenna beam inclined by a second angle relative to a rotation axis of the first antenna;

transmitting at least another antenna beam inclined by another angle relative to the rotation axis of the at least other antenna;

rotating each antenna about its axis; and rotating the antenna assembly about the main vertical axis, such that the multiple antennas cover complementary and different elevation fields.

* * * * *